United States Patent [19]

Suzuki et al.

[11] Patent Number: 4,492,570

[45] Date of Patent: Jan. 8, 1985

[54] CALCINING SYSTEM PROVIDED WITH A PLANETARY COOLER

[75] Inventors: Takeshi Suzuki; Mikio Murao; Masahiro Uchida; Chikanori Kumagai; Yasuhiko Yotsui, all of Kobi, Japan

[73] Assignee: Kawasaki Jukogyo Kabushiki Kaisha, Hyogo, Japan

[21] Appl. No.: 528,970

[22] Filed: Sep. 2, 1983

[30] Foreign Application Priority Data

Sep. 2, 1982 [JP] Japan ..... 57-153745
Dec. 9, 1982 [JP] Japan ..... 57-186280

[51] Int. Cl.[3] ..... F27B 7/02
[52] U.S. Cl. ..... 432/106; 432/80
[58] Field of Search ..... 432/80, 82, 77, 78, 432/106

[56] References Cited

U.S. PATENT DOCUMENTS

| | | | |
|---|---|---|---|
| 3,302,937 | 2/1967 | Pixley | 432/106 |
| 3,891,383 | 6/1975 | Kobayashi | 432/80 |
| 4,094,626 | 6/1978 | Boyhont et al. | 432/106 |
| 4,105,396 | 8/1978 | Ritzmann | 432/106 |
| 4,299,560 | 11/1981 | Nakamura et al. | 432/106 |

*Primary Examiner*—Henry C. Yuen

[57] ABSTRACT

A calcining system wherein raw material is preheated by raw material preheating device for preheating the raw material by contact with a gas, calcined in a rotary kiln and cooled in a planetary cooler; a portion of cooling gas used for cooling the calcined material in the planetary cooler and heated thereby is led through an air extracting duct to the raw material preheating device and the rest of the heated cooling gas is introduced into the rotary kiln: and exhaust gases from the rotary kiln is led to the raw material preheating device. Such calcining system further includes a first damper mounted in a duct for discharging the exhaust gas from the raw material preheating device, a temperature sensor for sensing the temperature of calcined material discharged through an outlet of the planetary cooler, control device for controlling the degree of opening of the first damper when the temperature sensed by the temperature sensor rises to a high level, a second damper mounted in the air extracting duct, a gas sensor for sensing a gas component capable of indicating the condition of combustion in the rotary kiln, and control device for controlling the degree of opening of the second damper so as to bring the value of the gas component sensed by the gas sensor to a predetermined level. The flow rate of the cooling air can be controlled independently of the control of the flow rate of the air combustion, so that the temperature of the calcined material at the outlet of the planetary cooler can be kept at a predetermined level selected arbitrarily and the combustion in the rotary kiln and the calciner can be stabilized irrespective of changes in the conditions of operation.

3 Claims, 23 Drawing Figures

CALCINING SYSTEM PROVIDED WITH A PLANETARY COOLER

BACKGROUND OF THE INVENTION

This invention relates to calcining systems provided with a planetary cooler, and more particularly it is concerned with a calcining system of the type described which is capable of effecting adjustments of the flow rate of a cooling fluid flowing through the cooler.

In a calcining system, such as a system for calcining cements, a planetary cooler provided with air extracting means is known for use with a rotary kiln for cooling clinker which comprises a plurality of cooling cylinders arranged parallel to the center axis of the rotary kiln and spaced apart equidistantly therefrom for movement around an orbit. Clinker in the cooling cylinders is cooled by cooling air which exchanges heat with the clinker and is heated, and a portion of the heated cooling air is led to the rotary kiln and the rest is extracted and led to other place, such as a calciner, as preheating air.

In a calcining system provided with this type of cooler, coating might fall in the rotary kiln and the operating condition might change, with a result that the clinker delivered to the planetary cooler might show variations in volume. The cooling air exhausted from the planetary cooler is supplied to a kiln or a calciner as air for combustion. It has hitherto been usual practice to keep the flow rate of the cooling air constant to stabilize the condition of combustion. Thus when the clinker is introduced in large volume into the planetary cooler, the clinker would not be cooled satisfactorily and clinker of high temperature would be discharged from the system. When the clinker discharged from the planetary cooler is not cooled satisfactorily, various troubles would ensue. The clinker of high temperature might give damage to the transporter or might reduce the quality of the clinker. The efficiency of the grinder might reduce. If cooling air is supplied to the planetary cooler in a quantity which is more than is necessary for the aforesaid combustion to effect cooling of the clinker satisfactorily, the temperature at which calcining of the clinker is effected would drop and the quality of the clinker would be reduced. In the prior art, proposals have been made to increase the length of the cooling cylinders of the planetary cooler, to apply a spray of water to the clinker or blowing a cooling stream of air against the clinker and to mount an additional cooler posterior to the planetary cooler, to obtain sufficient cooling of the clinker. However, these measures increase the cost and are bad economy.

SUMMARY OF THE INVENTION

An object of this invention is to provide a calcining system provided with a planetary cooler in which a cooling air flow rate is set independently of a combustion air flow rate so that the temperature of clinker at the outlet of the planetary cooler can be kept at an arbitrarily selected predetermined level irrespective of changes in the operating conditions and at the same time the combustion in the kiln and the calciner can be stabilized.

Another object is to provide a heat resisting air extracting device of planetary cooler to enable its stable and continuous operation.

DETAILED DESCRIPTION OF THE PREFERRED EMBODIMENTS

Preferred embodiments of the invention will now be described by referring to the accompanying drawings.

Figure 1:
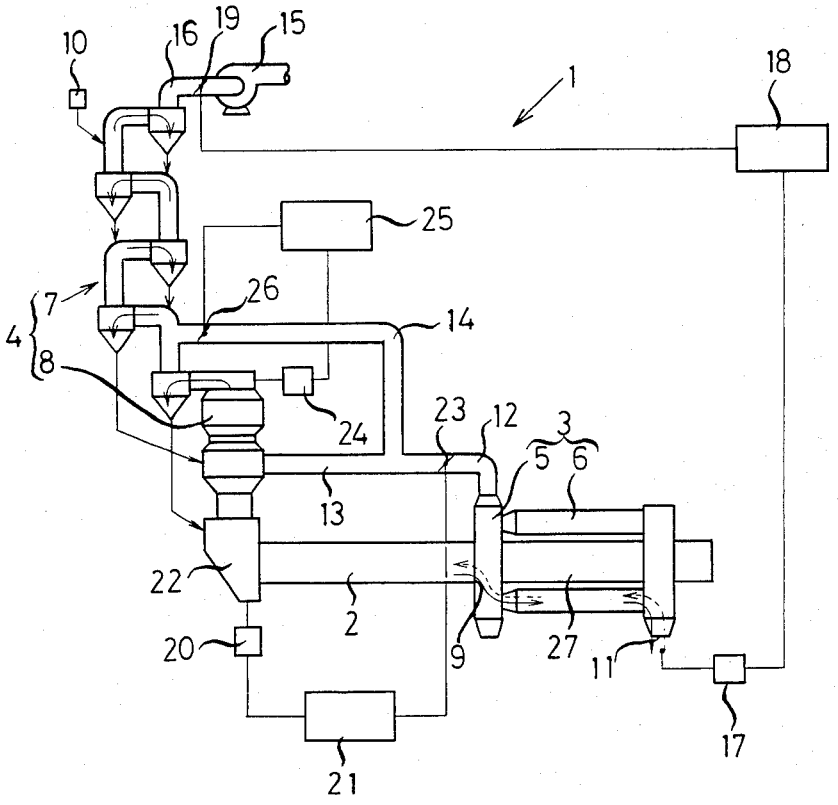
FIG. 1 is a schematic systematic view of one embodiment of the calcining system in conformity with the invention.

FIG. 1 is a systematic view, in a simplified form, of the calcining system provided with a planetary cooler comprising one embodiment of the invnetion. The calcining system 1 essentially comprises a rotary kiln 2, a planetary cooler 3 and raw material preheating means 4. The planetary cooler 3 comprises air extracting means 5, and a plurality of cooling cylinders 6 extending parallel to the center axis of the rotary kiln 2. The raw material preheating means 4 comprises suspension preheaters 7 in the form of a plurality of cyclones arranged vertically in a plurality of stages and connected together through ducts, and a calciner 8.

The center axis of the rotary kiln 2 is slightly inclined downwardly toward an outlet end 9 (the right side in FIG. 1) thereof through which clinker is discharged. The planetary cooler 3 is connected to the rotary kiln 2 through the outlet end 9. Raw material supplied in powder form from raw material supply 10 is fed into the suspension preheater 7 in a direction indicated by solid line arrows in which they are suspended in gas of high temperature and preheated. The preheated raw material is calcined in the calciner 8 before being introduced into the rotary kiln 2, in which the raw material is calcined by means of a burner 30 shown in FIG. 2 into clinker which is cooled in the planetary cooler 3 before being discharged through its outlet 11 as product. Cooling air is supplied through the outlet 11 of the planetary cooler 3 to cool the clinker in the cooling cylinders 6 of the planetary cooler 3, and a portion of the cooling air that has become high in temperature after contact with the hot cliker is drawn off the planetary cooler 3 through the air extracting means 5 thereof and introduced into the rotary kiln 2 for use as combustion air. The rest of the heated cooling air is led to the calciner 8 through an air extracting duct 12 and a branch duct 13 and to the suspension preheater 7 through a branch duct 14 to be used as preheating air. The air extracting duct 12 and branch duct 14 have a second damper 23 and a third damper 26 mounted therein respectively. Gas exhausted from the rotary kiln 2 is led through the calciner 8 to the suspension preheater 7, and gas exhausted from the suspension preheater 7 is led through a duct 16 mounting a first damper 19 to an exhaust blower 15 from which the gas is exhausted to outside. The position in which the heated cooling air is introduced through the branch duct 14 into the suspension preheater 7 only has to be on the downstream side of the calciner 8 with respect to the flow of the exahust gas.

Figure 2:
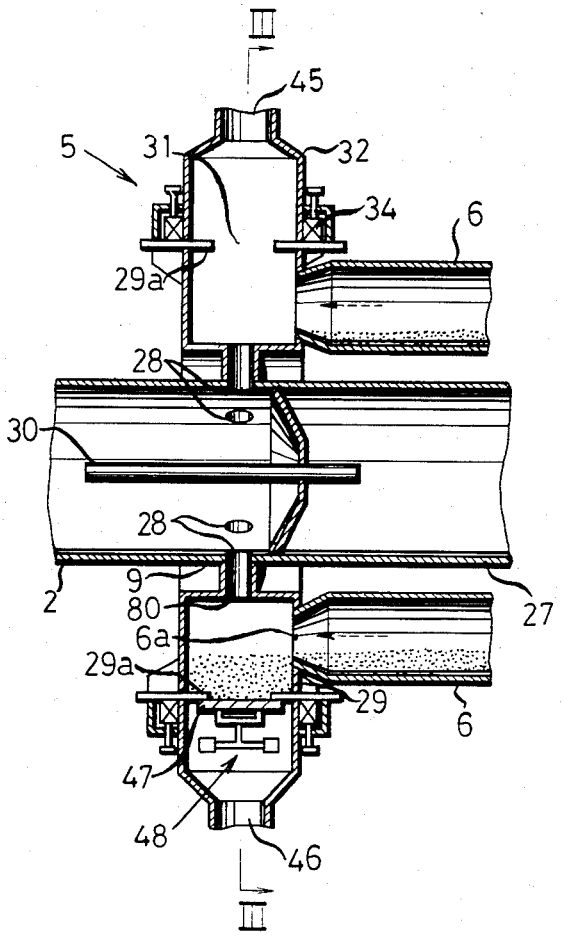
FIG. 2 is a sectional view of the vicinity of the air extracting means of the calcining system shown in FIG. 1.
Figure 3:
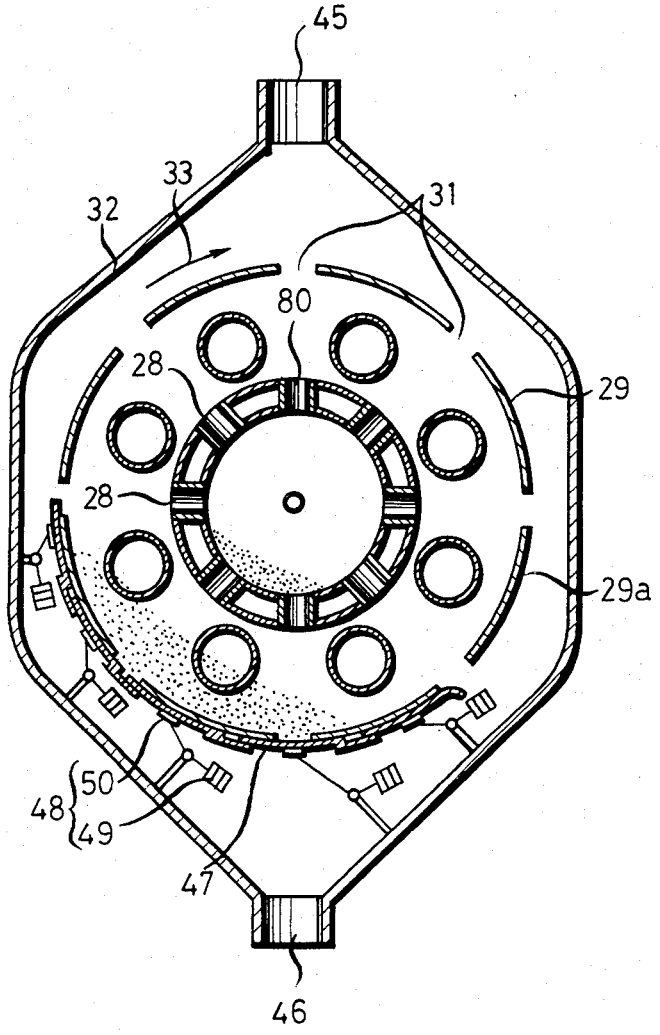
FIG. 3 is a sectional view taken along the line III—III in FIG. 2.

FIG. 2 is a sectional view of the vicinity of the air extracting means 5 shown in FIG. 1, and FIG. 3 is a sectional view taken along the line III—III in FIG. 2. A support cylinder 27 is connected unitarily to the outlet end 9 of the rotary kiln 2 in coaxial relationship. The outlet end 9 of the rotary kiln 2 is formed with a plurality of outlet apertures 28, which are eight (8) in number in the embodiment shown and described herein, arranged peripherally on an outer wall surface of the outlet end 9 of the rotary kiln 2 and located in positions equidistantly spaced apart from one another. The outlet apertures 28 are connected through chutes 80 respectively to an annular receiving and distributing pipe 29 located cocentrically with the rotary kiln 2 and radially outwardly spaced apart therefrom in such a manner that it surrounds the support cylinder 27. The plurality of or eight cooling cylinders 6 are connected at their reduced diameter end portions to a wall of the annular receiving and distributing pipe 29 at its front side and extend parallel to the center axis of the rotary kiln 2 in a direction away therefrom, so that the cooling cylinders 6 are arranged in the form of planets moving in an orbit for rotating with the rotary kiln 2 as a unit.

The receiving and distributing pipe 29 is formed at its outer peripheral surface 29*a* with a plurality of air extracting apertures 31 which are eight (8) in number in the embodiment shown and described herein located in positions equidistantly spaced apart from one another peripherally of the pipe 29 which is enclosed by a hood 32 which is a housing for air extraction from the planetary cooler 3 supported in a fixed position seal means 34 for providing a seal to the interior of the receiving and distributing pipe 29 and the interior of the hood 32 with respect to outside while allowing the receiving and distributing pipe 29 to rotate in the direction of an arrow 33 in FIG. 3 is mounted between the hood 32 and receiving and distributing pipe 29.

Figure 4:
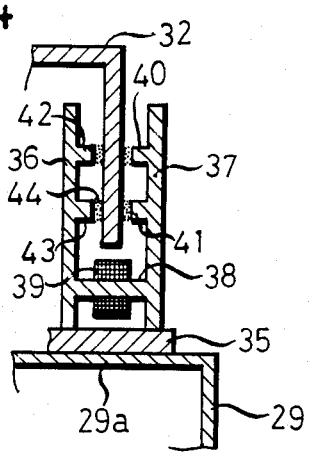
FIG. 4 is a sectional view of one example of the seal means shown in FIG. 3.

FIG. 4 shows one example of the seal means 34 in a sectional view in which an annular member 35 formed of non-magnetic material, such as stainless steel, ceramic material, etc., is secured to the outer peripheral surface 29*a* of the receiving and distributing pipe 29, and a pair of ring-shaped seal members 36 and 37 are secured to the annular member 35 in a manner to be spaced apart from each other axially of the support cylinder 27 and extend in planes perpendicular to the center axis of the support cylinder 27. The seal members 36 and 37 are connected together by a plurality of connectors 38 while their surfaces facing each other are spaced apart from each other axially of the receiving and distributing pipe 29. The connectors 38 each have a coil 39 wound thereon. The seal member 36 and 37 have annular projections facing each other and forming pairs, such as two pairs of annular projections 40, 41 and 42, 43, and the hood 32 is loosely fitted between the two seal members 36 and 37. The hood 32, seal members 36 and 37 and connectors 38 are formed of material of high permeability.

In the seal means 34 of the aforesaid construction, magnetic powder 44 is interposed between the seal members 36 and 37 and the hood 32. The magnetic powder 44 is held in position in gaps between the annular projections 40–43 and the hood 32 by lines of magnetic force emanating from the coils 39. The magnetic powder 44 having fluidity, the hood 32 and the receiving and distributing pipe 29 are allowed to move in relative rotary movement and yet a seal is positively provided to the interior of the hood 32 and the interior of the receiving and distributing pipe 29 in positions in which the annular projections 40, 41, 42 and 43 are located.

The seal means 34 shown in FIG. 4 is one example thereof and the invention is not limited to the seal means 34 of the construction shown in FIG. 4.

An air extracting pipe 45 is connected to an upper portion of the hood 32 at one end thereof and to the air extracting duct 12 (FIG. 1) at the other end thereof for extracting air. A discharge port 46 is formed in a lower portion of the hood 32 for discharging clinker that have dropped thereinto.

A plurality of sliding contact members 47 bent to conform to the outer peripheral surface 29*a* of the annular receiving and distributing pipe 29 are forced into sliding contact with the outer peripheral surface 29*a* by biasing means 48. The sliding contact members 47 are shaped such that portions thereof disposed on the upstream side with respect to the direction of rotation of the receiving and distributing pipe 29 are spaced apart from the outer peripheral surface 29*a* of the receiving and distributing pipe 29, to enable the sliding contact members 47 to be maintained smoothly in sliding contact with the outer peripheral surface 29*a* of the receiving and distributing pipe 29. The sliding contact members 47 are mounted with no gaps therebetween, as shown in FIG. 3. The biasing means 48 each comprise a weight 49 and a pressing member 50, and the pressing member 50 presses the respective sliding contact member 47 against the outer peripheral surface 29*a* of the pipe 29 by the force of gravity applied by the weight 49.

In the planetary cooler 3 including the air extracting means 5 of the aforesaid construction, the clinker calcined in the rotary kiln 2 move downwardly into the receiving and distributing pipe 29 through the outlet apertures 28. The clinker collected in a lower portion of the receiving and distributing pipe 29 is introduced into the cooling cylinders 6 as the receiving and distributing pipe 29 rotates and move through the cooling cylinders 6. In the lower portion of the receiving and distributing pipe 29, the air extracting apertures 31 are each closed by one of the slide contacting members 47, so that the clinker is kept from dropping through the air extracting apertures 31 into the hood 32.

Meanwhile air is fed into the cooling cylinders 6 as indicated by broken line arrows in FIGS. 1 and 2 and flows in countercurrent to the clinker in the cooling cylinders 6 and heat exchange takes place between the air and the clinker, so that the air heated by cooling the clinker is led into the receiving and distributing pipe 29. A portion of the air further heated in the receiving and distributing pipe 29 is led through the air extracting pipe 45 to the air extracting duct 12 (FIG. 1), and the rest of the heated air is introduced into the rotary kiln 2 where it is used as combustion air.

In the embodiment shown and described hereinabove, the temperature of the clinker discharged through the outlet 11 of the planetary cooler 3 is sensed by a temperature sensor 17 and the degree of opening of the first damper 19 is controlled by control means 18 to keep the temperature of the clinker at a predetermined level. When the temperature of the clinker at the outlet 11 rises to a level higher than the predetermined level, the degree of opening of the first damper 19 is increased to increase the flow rate of exhaust gas from the suspension preheater 7 and hence the flow rate of the cooling air. The cooling air heated to a high temperature level is distributed between the air extractig duct 12 and rotary kiln 2. Control of the flow rate of the air distributed to them is effected as follows. A gas component, such as an oxygen concentration, which is able to indicate the condition of combustion in the rotary kiln 2 is sensed by a gas sensor 20 at a feed side 22 of the kiln 2, and the degree of opening of the second damper 23 is controlled by control means 21 in such a manner that the value sensed by the gas sensor 20 becomes a desired value or 2.0 volume percent, for example. When the oxygen concentration at the feed side 22 of the kiln 2 is lower than the predetermined value, for example, the degree of opening of the second damper 23 is reduced to increase the flow rate of the air introduced into the rotary kiln 2. The heated cooling air from the air extracting duct 12 is distributed between the branch duct 14 and branch duct 13 as aforesaid. Control of the flow rate of air distributed to the two ducts 13 and 14 is effected as follows. A gas component, such as an oxygen concentration, which is capable of indicating the condition of combustion in the calciner 8 is sensed by a gas sensor 24 at an outlet of the calciner 8, and the degree of opening of the third damper 26 mounted in the branch duct 14 is controlled by control means 25 in such a manner that the value sensed by the gas sensor 24 becomes a desired value or 1.5 volume percent for example. When the oxygen concentration is lower than the predetermined value, for example, the degree of opening of the third damper 26 is reduced. It is because the branch duct 14 has a smaller loss of pressure than the branch duct 13 and control of the flow rate of air can be effected more readily than the third damper 26 which is mounted in the branch duct 14.

In the calcining system provided with the planetary cooler 3 of the aforesaid construction, the temperature of the clinker is sensed at the outlet of the planetary cooler 3 and the degree of opening of the first damper 19 is controlled in such a manner that the value sensed becomes equal to the predetermined value. Thus it is possible to obtain clinker of an arbitrarily selected temperature level. Moreover, the second damper and third damper are controlled in such a manner that desired oxygen concentration is established in the rotary kiln 2 and the calciner 8, so that combustion in the rotary kiln 2 and the calciner 8 can be stabilized and production of $NO_X$ in the calciner 8 can be inhibited. Since the exhaust from the rotary kiln 2 is led to the calciner 8, denitration of the $NO_X$ in the exhaust gas from the rotary kiln 2 can be effected. Air is introduced into the calciner 8 at a flow rate only necessary for combustion, so that it is possible to obtain a compact size in a calciner.

Figure 5:
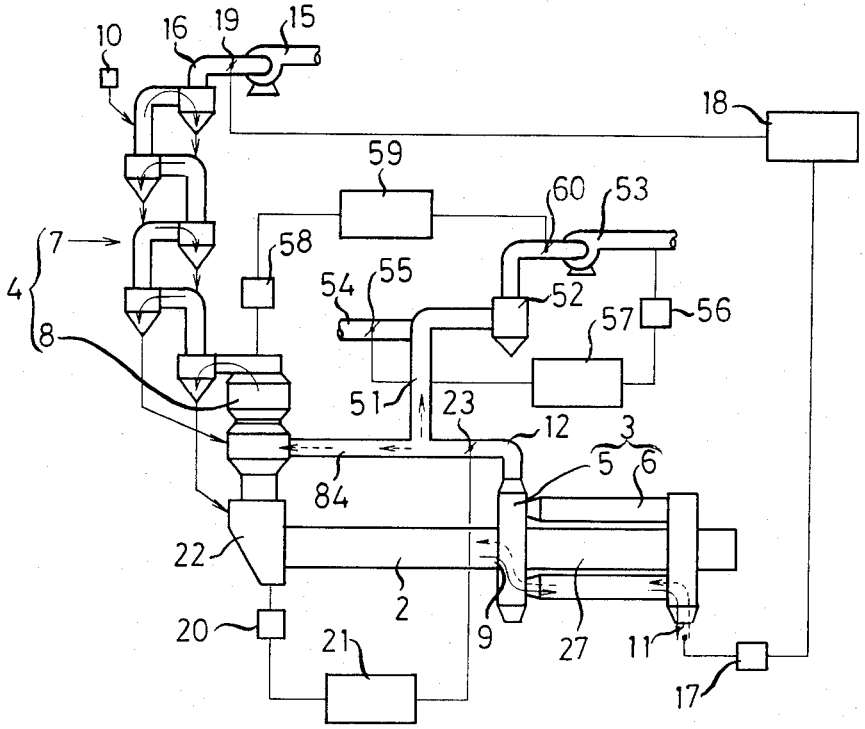
FIGS. 5–9 are schematic systematic views of other embodiments of the calcining system in conformity with the invention.

FIG. 5 is a systematic view showing another embodiment of the invention, in which parts similar to those shown in FIGS. 1–4 are designated by like reference characters. What is noteworthy is that the air extracting duct 12 branches into branch ducts 84 and 51 in a position on the downstream side of the second damper 23 with respect to the flow of the heated air. A portion of the heated air from the air extracting duct 12 flows through the branch duct 51 to an exhaust blower 53 from which it is released to the atmosphere. A dust collector 52 is mounted in the branch duct 51. The rest of the heated air from the air extracting duct 12 is led through the branch duct 84 to the calciner 8. The branch duct 51 has connected thereto in a position on the upstream side of the duct collector 52 with respect to the flow of the heated air a duct 54 mounting a damper 55 and open to the atmosphere. Cooling air is led from the atmosphere through the duct 54 to cool the heated air, so as to protect the dust collector 52 and exhaust blower 53 from the heated air. The flow rate of the cooling air introduced through the duct 54 is adjusted by controlling the degree of opening of the damper 55. The degree of opening of the damper 55 is controlled by control means 57 in such a manner that the temperature of air exhausted by the exhaust blower 53 is sensed by a temperature sensor 56 and the temperature of the air is adjusted to a level which does not adversely affect the dust collector 52 and blower 53. The heated air from the air extracting duct 12 is distributed to the branch ducts 51 and 84. Adjustments of the flow rate of the distributed air are effected in such a manner that an oxygen concentration at the outlet of the calciner 8 is sensed by a gas sensor 58 and the degree of opening of the third damper 60 located on the upstream side of the exhaust blower 53 is adjusted by control means 59 to make the oxygen concentration have a predetermined value or 1.5 volume percent, for example. When the oxygen concentration sensed is lower than the predetermined value, for example, the degree of opening of the third damper 60 is reduced. Other parts are similar to those of the embodiment shown in FIGS. 1–4.

The heated excess air is released to the atmosphere by the exhaust blower 53 separate from the exhaust blower 15 for exhausting gas from the suspension preheaters 7, so that the flow rate of air adjusted by the first damper 19 is difficultly affected by changes in pressure in the suspension preheaters 7. The loss of pressure is decreased and consumption of power by the exhaust blower is reduced when the heated excess air is directly released to the atmosphere as compared with the arrangement whereby it is released through the suspension preheater 7.

Figure 6:
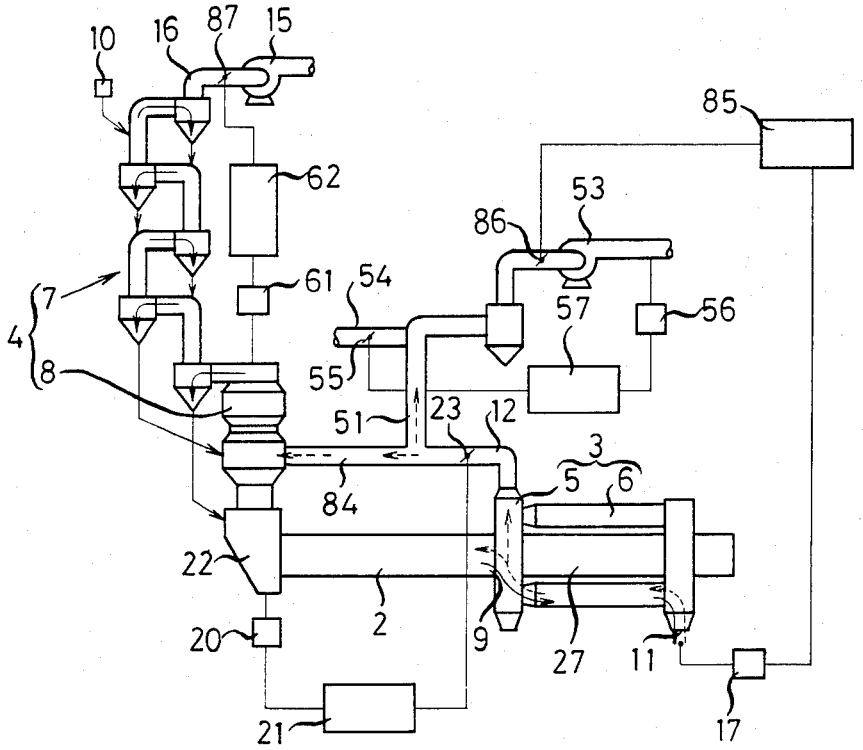

FIG. 6 is a systematic view of still another embodiment, in which parts similar to those shown in FIG. 5 are designated by like reference characters. In the embodiment shown in FIG. 6, a first damper 86 mounted in the branch duct 51 connected to the exhaust blower 53 has its degree of opening controlled by control means 85 in such a manner that the temperature of clinker sensed by the temperature sensor becomes equal to a predetermined value. For example, when the sensed temperature of clinker is higher than the predetermined value, the degree of opening of the first damper 86 is increased. A third damper 87 mounted in the duct 16 for introducing exhaust gas from the suspension preheater 7 has its degree of opening controlled by control means 62 in such a manner that an oxygen concentration sensed at the outlet of the calciner 8 by a gas sensor 61 becomes equal to a predetermined value. For example, when the sensed concentration is below the predetermined value, the degree of opening of the third damper 87 is increased. Other parts of the embodiment are similar in construction to those of the embodiment shown in FIG. 5. In this embodiment, control of the oxygen concentration in the calciner 8 and hence the combustion condition in the calciner 8 can be readily adjusted.

Figure 7:
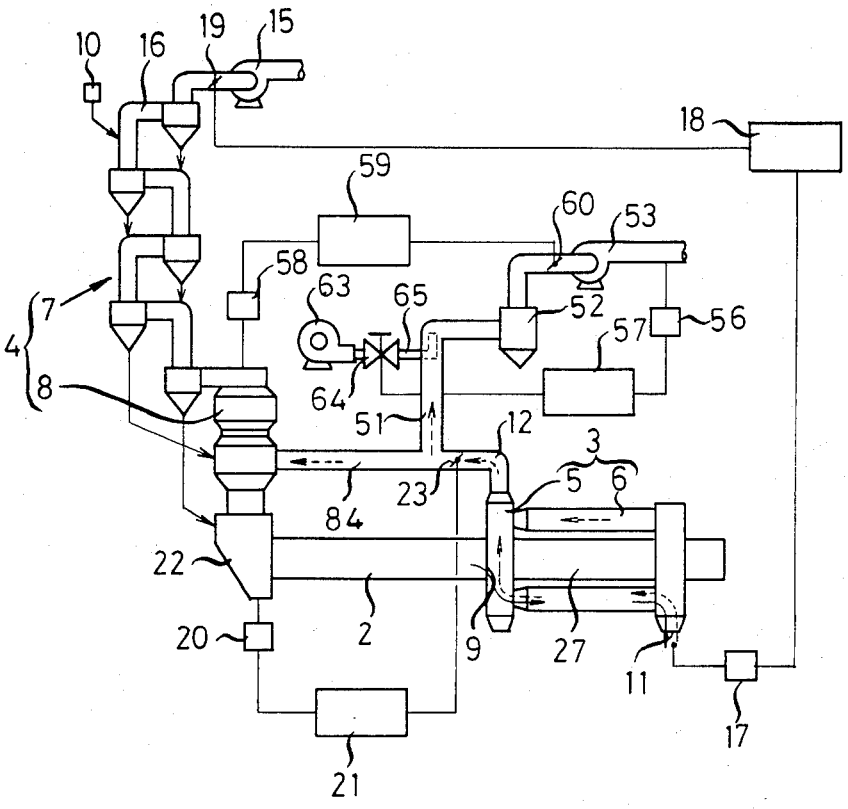

FIG. 7 shows still another embodiment, in which parts similar to those shown in FIG. 5 are designated by like reference characters. In the embodiment shown in FIG. 7, the latent heat of water from a pump 63 is utilized for cooling the air of elevated temperature in the branch duct 51. The water from the pump 63 is led through a flow rate adjusting valve 64 and via a conduit 65 to the branch duct 51 on the upstream side of the dust collector 52. The volume of the cooling water is adjusted by controlling the flow rate adjusting valve 64 by control means 57 in such a manner that the temperature sensed by the temperature sensor 56 becomes equal to a predetermined value, as is the case with the embodiment shown in FIG. 5. Other parts are similar in construction to those shown in FIG. 5.

Figure 8:
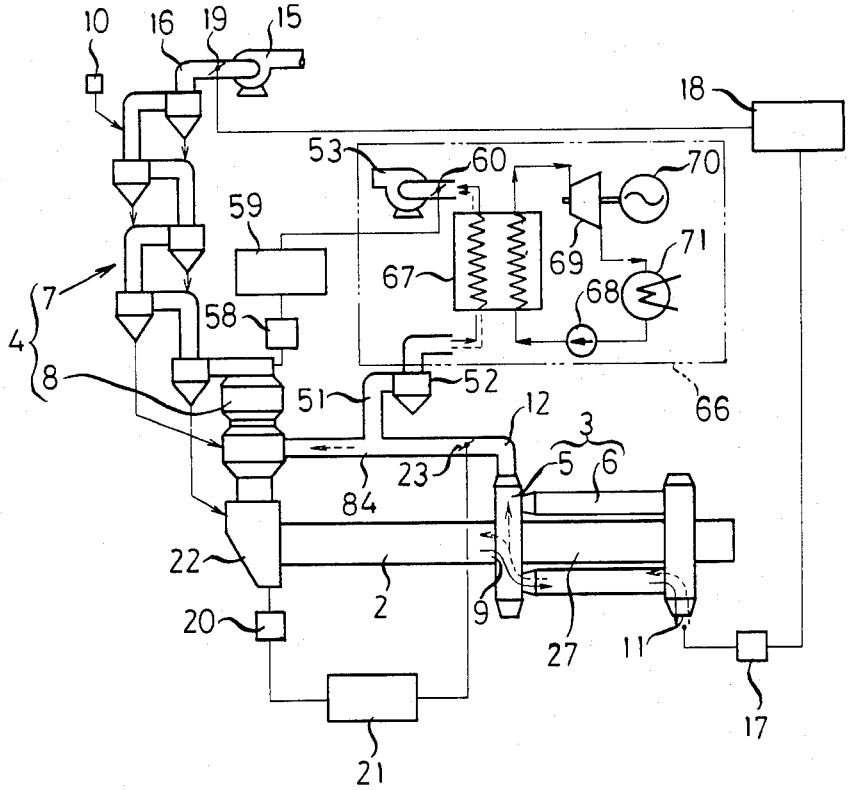

FIG. 8 shows still another embodiment similar to the one shown in FIG. 5. In FIG. 8, parts similar to those shown in FIG. 5 are designated by like reference characters. Generator means 66 is located between the dust collector 52 and exhaust blower 53. Heated air from the dust collector 52 is subjected to heat exchange in a boiler 67 with water from a pump 68 and discharged through the exhaust blower 53. Steam is generated in the boiler 67 by the heat exchanger for driving a turbine 69 to generate electricity by a generator 70. The steam from the turbine 69 is changed to water in a condenser 71. The provision of the generator means 66 makes it possible to make effective use of waste heat. Other parts are similar to those shown in FIG. 5.

Figure 9:
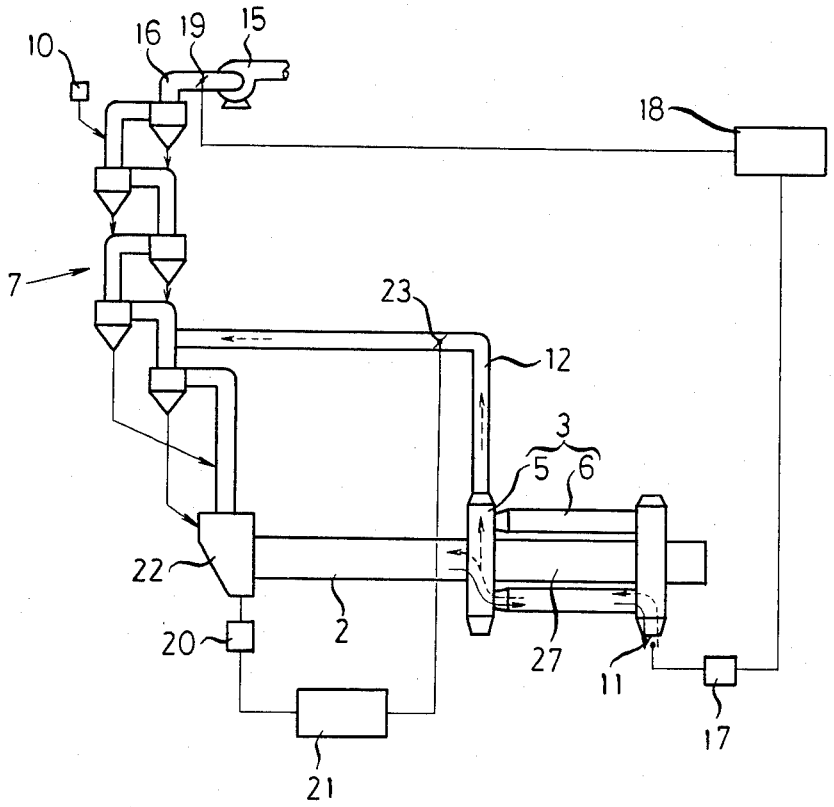

FIG. 9 shows still another embodiment which is similar to the embodiment shown in FIG. 1. Parts in FIG. 9 similar to those shown in FIG. 1 are designated by like reference characters. This embodiment has no calcining furnace. Raw material preheated in the suspension preheaters 7 is led directly to the rotary kiln 2. The air of elevated temperature from the planetary cooler 3 is distributed between the rotary kiln 2 and the air extracting duct 12 connected to the suspension preheaters 7 in a position downstream of the rotary kiln with respect to the direction of flow of the exhaust gas. The flow rate of the air of elevated temperature distributed to the rotary kiln 2 and the air extracting duct 12 is adjusted by controlling the degree of opening of the second damper 23 by the control means 21 in such a manner that an oxygen concentration at the feed side 22 of the kiln 2 sensed by the gas sensor 20 becomes equal to a predetermined value or 2.0 volume percent, for example. Other parts are similar in construction to those shown in FIG. 1.

Figure 10:
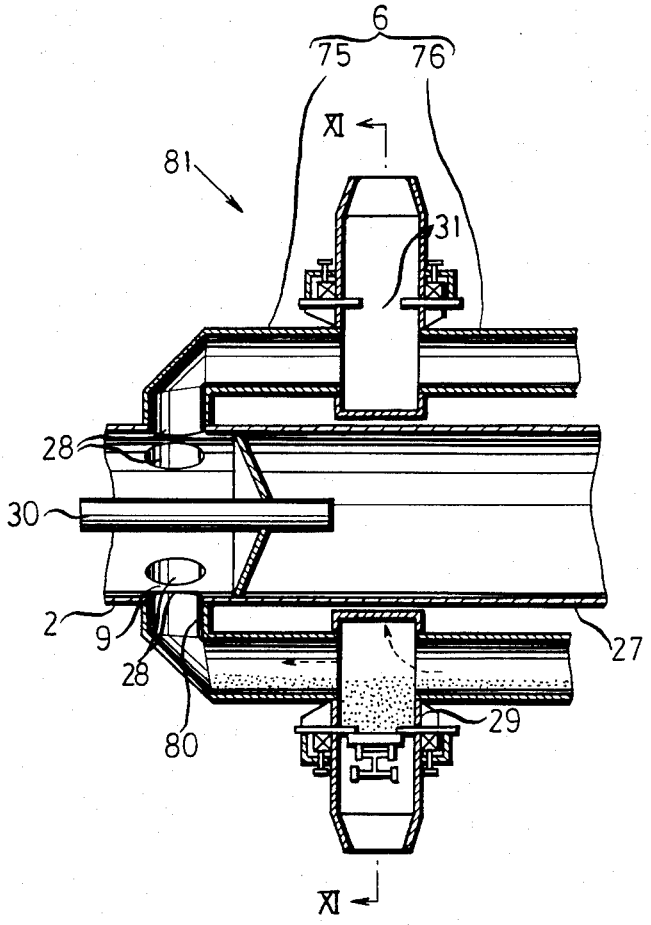
FIG. 10 is a sectional view of another example of the air extracting means.
Figure 11:
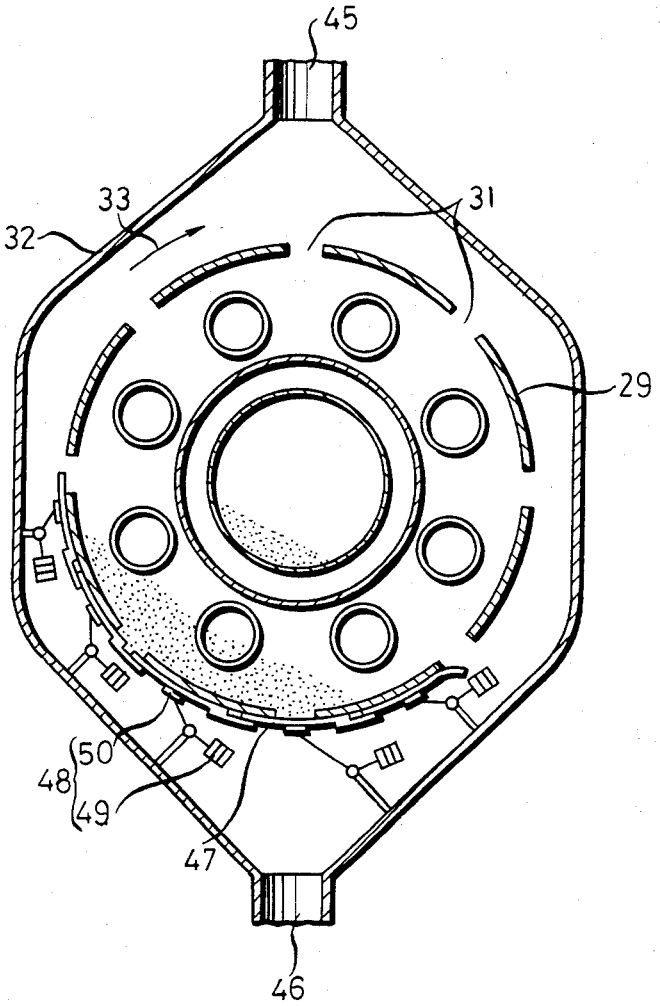
FIG. 11 is a sectional view taken along the line XI—XI in FIG. 10.

FIG. 10 is a sectional view of air extracting means 81 representing a modification of the air extracting means 5 shown in FIG. 5 which can have application in the embodiments shown and described hereinabove. FIG. 11 is a sectional view taken along the line XI—XI in FIG. 10. Parts similar to those shown in FIG. 2 are designated by like reference characters. What is noteworthy is that in this embodiment the cooling cylinders 6 each consist of first and second cooling cylinder members 75 and 76 and air is extracted from the cooling cylinders 6 at the junctions of the first and second cooling cylinder members 75 and 76. More specifically, the plurality of outlet apertures 28 formed at the outlet end 9 of the rotary kiln 2 are each communicated with one end portion of one of the first cooling cylinder members 75 of the cooling cylinders 6 through one of the chutes 80, and the other end portion of each of the first cooling cylinder members 75 is communicated with the annular receiving and distributing pipe 29 surrounding the support cylinder 27 in spaced-apart relation. The second cooling cylinder members 76 of the cooling cylinders 6 each coaxial with one of the first cooling cylinder members 76 are communicated with the receiving and distributing pipe 29 which is formed with the plurality of air extracting apertures 31 described by referring to the embodiment shown in FIG. 1.

By drawing air off the cooling air cylinders 6 in a portion thereof which is located midway between opposite ends thereof as described hereinabove, it is possible to introduce to the air extracting duct 12 air of relatively low temperature and to allow air of relatively high temperature to be introduced into the rotary kiln 2 through the chutes 80. This enables a high calcining temperature to be obtained in the rotary kiln 2, making it possible to reduce fuel consumption and improve the quality of the clinker produced.

Figure 12:
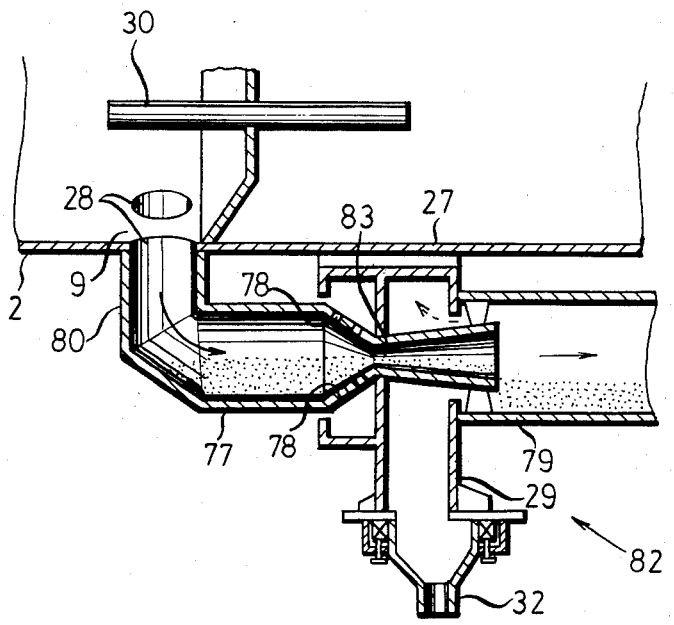
FIG. 12 is a sectional view of still another example of the air extracting means.

FIG. 12 is a fragmentary sectional view of the vicinity of air extracting means 82 of a modified form which can have application in the embodiments shown and described hereinabove. The air extracting means 82 is similar to the one shown in FIGS. 10 and 11, and parts shown in FIG. 12 similar to those shown in FIGS. 10 and 11 are designated by like reference characters. Clinker moving downwardly through the outlet apertures 28 of the rotary kiln 2 is led through the chutes 80 to the first cooling cylinder members 77 which are each formed with air intake ports 78 for admitting cooling air. The first cooling cylinder members 77 are each formed with a constricted portion 83 at which the cooling cylinder member 77 gradually becomes smaller in diameter toward the receiving and distributing pipe 29 and increases its diameter in the direction of movement of the clinkers, as indicated by a solid line arrow, after penetrating the receiving and distributing pipe 29. The first cooling cylinder members 77 each open at a downstream end portion thereof with respect to the direction of movement of the clinker in one of the second cooling cylinder members 79. The provision of the contracted portion 83 in each first cooling cylinder member 77 causes heated air in the second cooling cylinder members 79 to flow into the hood 32 and air extracting duct 12, in place of flowing into the first cooling cylinder members 77 into which air is introduced through the air intake ports 78. By this arrangement, the clinker in the first cooling cylinder members 77 is suddenly cooled and their quality can be improved. Also the clinker is sufficiently cooled in a cooling zone in a front portion of the rotary kiln 2, and choking of the outlet apertures 28 due to adhesion of the clinker can be avoided, so that movement of the clinker from the rotary kiln 2 through the outlet apertures 28 to the first cooling cylinder members 77 takes place smoothly. Although the flow rate of air led to the rotary kiln from the cooler 3 is reduced due to it being led to the air extracting duct 12, it is not necessary to increase the area of the cooling zone. Other parts of the embodiment shown in FIG. 12 are similar to the corresponding ones shown in FIG. 10.

Figure 13:
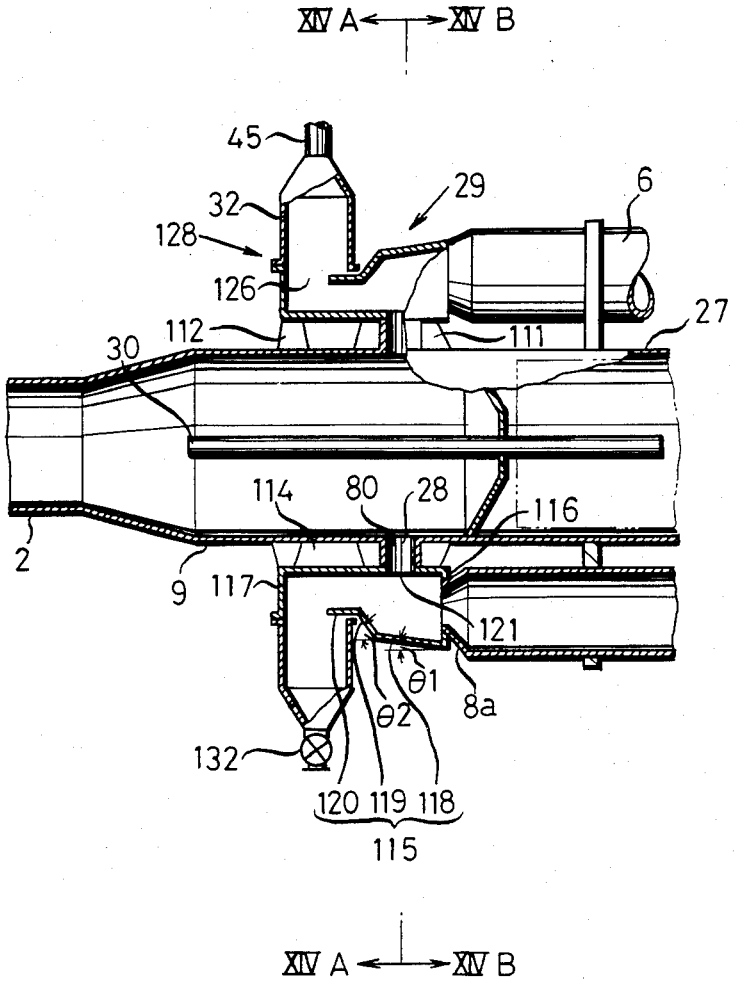
FIG. 13 is a sectional view of still another example of the air extracting means.
Figure 14:
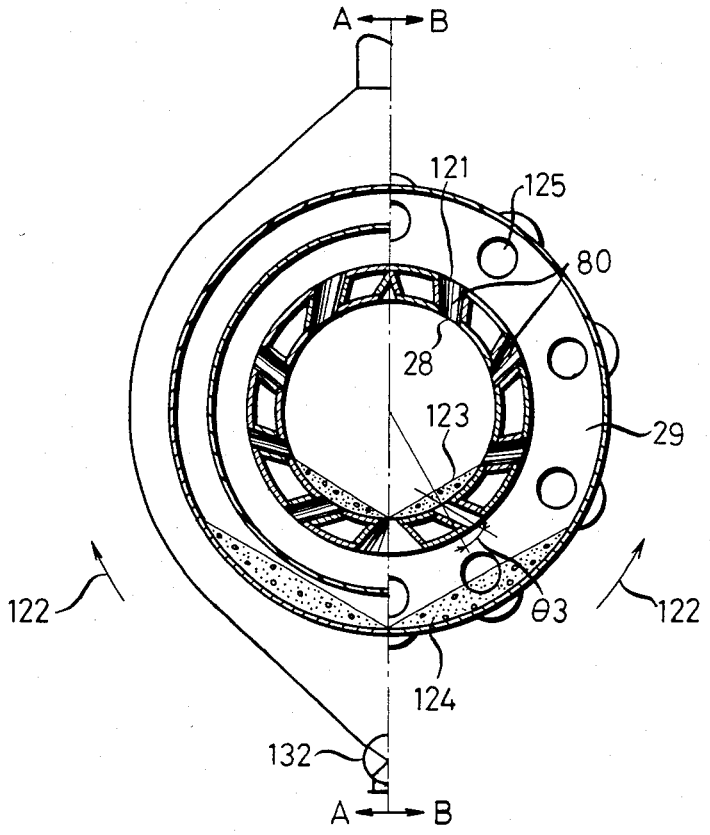
FIG. 14 is a sectional view of the air extracting means shown in FIG. 13.
Figure 15:
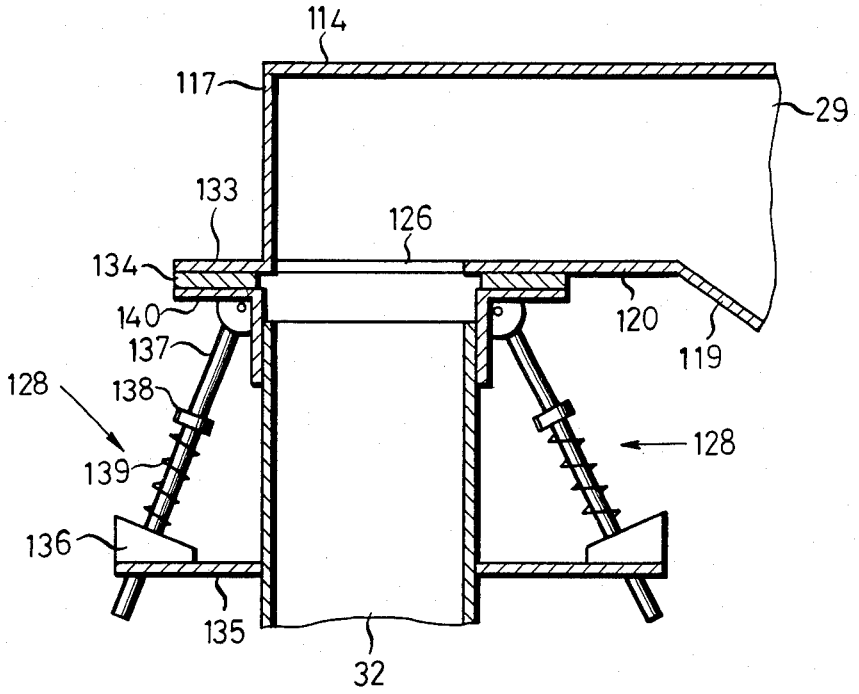
FIG. 15 is a sectional view showing in detail the seal means for the air extracting means shown in FIG. 14.

FIG. 13 is a vertical sectional view of still another example of the air extracting means which can have application in the embodiments shown and described hereinabove. FIG. 14 shows in its left half-portion a sectional view taken along the line XIVA—XIVA in FIG. 13 and in its right half-portion a sectional view taken along the line XIVB—XIVB in FIG. 13. The air extracting means shown in FIG. 13 is distinct from the one shown in FIG. 12 as follows. The receiving and distributing pipe 29 comprises an inner cylindrical portion 114, an outer cylindrical portion 115, a front end wall 116 and a rear end wall 117. The outer cylindrical portion 115 includes a major diameter cylindrical portion 118, an intermediate diameter cylindrical portion 119 and a minor diameter cylindrical portion 120. The chutes 80 are each inclined by an angle $\theta 3$ in the direction of rotation of the rotary kiln 2 indicated by an arrow 122 in FIG. 14 with respect to the radius of the kiln 2, so that a material 123 calcined at the outlet end 9 drops onto a material 124 collected in the receiving and distributing pipe 29. This is conducive to prevention of damage which might otherwise be caused to a lining applied to the inner wall surface of the receiving and distributing pipe 29. The major diameter cylindrical portion 118 of the outer cylindrical portion 115 is in the form of a conical surface which is inclined by an angle $\theta 1$ with respect to the axis of the rotary kiln 2 so as to have its diameter reduced in going toward the kiln 2. By this arrangement, the material 124 collected in the receiving and distributing pipe 29 does not stay therein and moves toward the cooling cylinders 6 and its movement toward the minor diameter cylindrical portion 120 can be avoided. The intermediate diameter cylindrical portion 119 is in the form of a conical surface which is inclined by an angle $\theta 2$ with respect to the axis of the rotary kiln 2 so that its diameter is reduced in going toward the rotary kiln 2. By this arrangement, backward movement of the material 124 in the receiving and distributing pipe 29 toward the minor diameter cylindrical portion 120 can be positively avoided and the air can be made to flow smoothly, thereby reducing a loss of pressure.

The minor diameter cylindrical portion 120 is formed with an annular air extracting opening 126 located in a radially outward portion of the receiving and distributing pipe 29 and maintained in communication with the hood 32 supported in a fixed position in such a manner that an airtight seal is provided by seal means 128 between the pipe receiving and distributing 29 and hood 32. The hood 32 has a valve 132 mounted in its lower portion for removing dust therethrough.

FIG. 5 is a sectional view of the seal means 128 for providing an airtight seal between the hood 32 and the receiving and distributing pipe 29. The rear end wall 117 of the receiving and distributing pipe 29 is formed with an annular flange 133 extending axially of the pipe 29 and having a seal member 134 secured to its radially outward surface. The hood 32 has a flange 135 provided to its outer wall surface and having secured thereto a bedplate 136 through which a threaded rod 137 loosely extends. A spring support 138 threadably engages the threaded rod 137 for movement axially of the threaded rod 137, and a spring 139 is mounted between the bedplate 136 and the spring support 138. A seal member 140 in the form of a letter L split into sections peripherally of the receiving and distributing pipe 29 is secured to an end of the threaded rod 137. The seal member 140 is forced by the biasing force of the spring 139 against the seal member 134. The sections of the seal member 140 are adjacent one another peripherally of the receiving and distributing pipe 29. By using the seal means 128 of the aforesaid construction, an airtight seal can be provided between the receiving and distributing pipe 29 and the hood 32. The seal means 128 is mounted on either side of the hood 32 with respect to the axis of the rotary kiln 2.

In this embodiment, the outlet end 9 of the rotary kiln 2 has an increased diameter, so that a portion of the kiln 2 at the outlet end 9 has a larger volume than other portions of the kiln 2. By this arrangement, even if the flow rate of air for combustion to the outlet end 9 of the kiln 2 is reduced due to the air being diverted to the air extracting duct 12, the clinker can be cooled to the range between 1250° and 1200° C. and fully solidified before moving to the receiving and distributing pipe 29 through the chutes 80.

Figure 16:
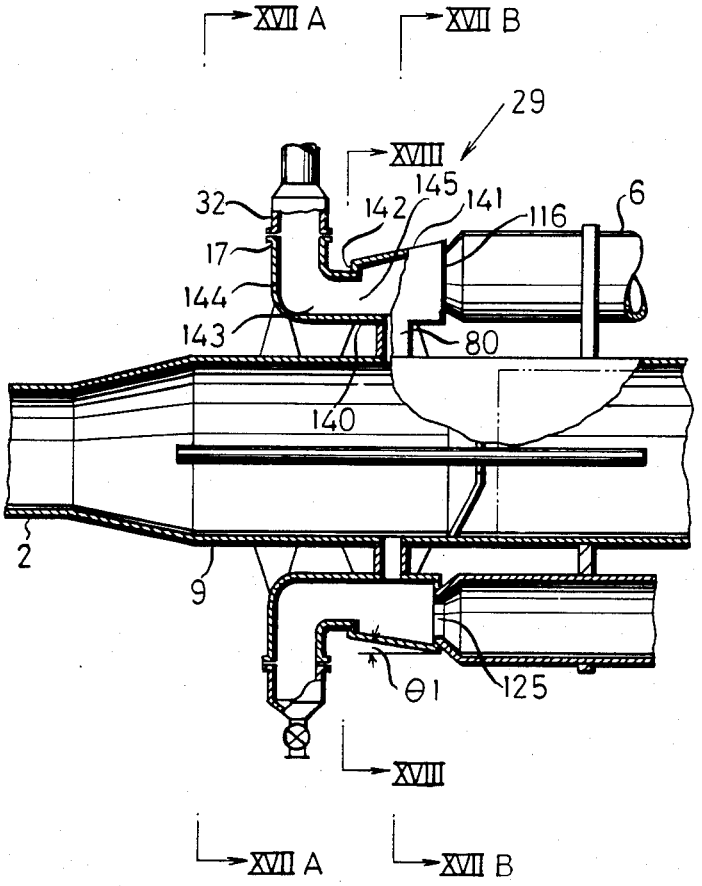
FIG. 16 is a sectional view of still another example of the air extracting means.
Figure 17:
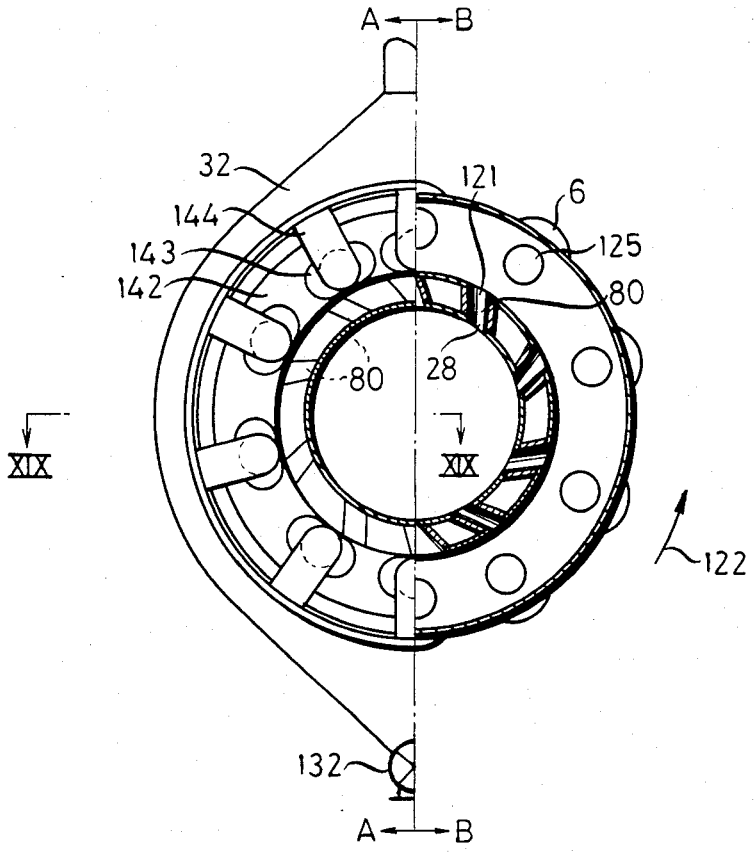
FIG. 17 is a sectional view of the air extracting means shown in FIG. 16.
Figure 18:
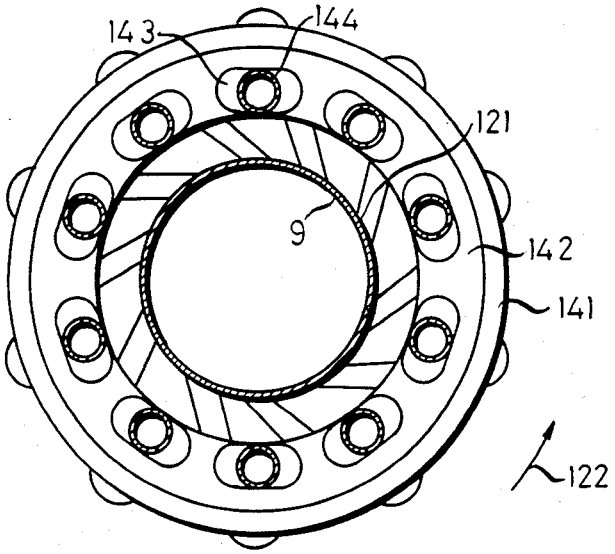
FIG. 18 is a sectional view taken along the line XVIII—XVIII in FIG. 16.
Figure 19:
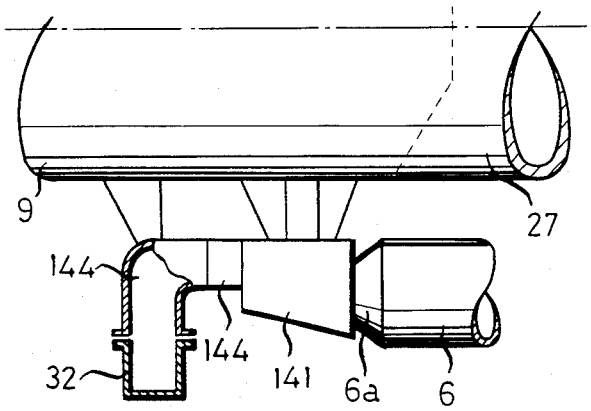
FIG. 19 is a sectional view taken along the line XIX—XIX in FIG. 17.
Figure 20:
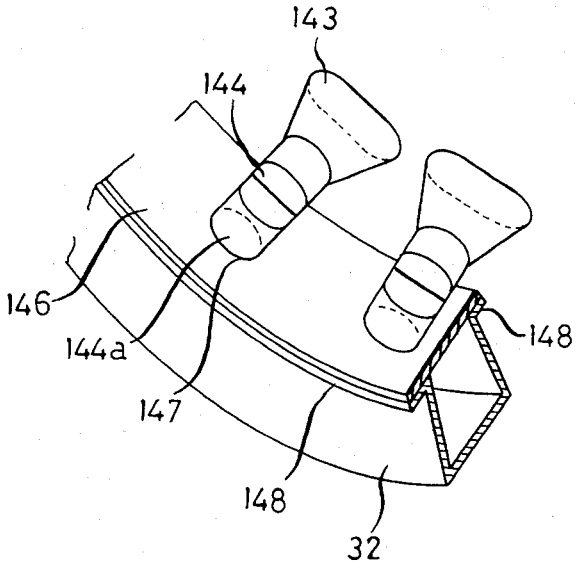
FIG. 20 is a perspective view of a portion of the air extracting means shown in FIGS. 16–19.

FIG. 16 is a vertical sectional view of still another example of the air extracting means, and FIG. 17 shows in its left half-portion a sectional view taken along the line XVIIA—XVIIA in FIG. 16 and in its right half-portion a sectional view taken along the line XVIIB—XVIIB in FIG. 16; FIG. 18 is a sectional view taken along the line XVIII—XVIII in FIG. 16; and FIG. 19 is a sectional view, in a simplified form, taken along the line IXX—IXX in FIG. 17. Parts shown in FIGS. 16–19 similar to those shown in FIGS. 13–16 are designated by like reference characters. What is noteworthy in this embodiment is that the receiving and distributing pipe 29 comprises an inner cylindrical member 140 connected to the outlet end 9 of the kiln 2 through the chutes 80, an outer cylindrical member 141 reducing its diameter in going toward the kiln 2 by an angle $\theta 1$ with respect to the center axis of the kiln 2, a front end wall 116 to which the cooling cylinders 6 are connected, and a rear end wall 142. The rear end wall 142 communicates through air ducts 145 with cylinders 143 at an end thereof opposite its end at which the cooling cylinders 6 are connected thereto. The cylinders 143 each have a cylinder 142 connected thereto and bent radially outwardly substantially at 90 degrees. The air ducts 145 extend axially of the receiving and distributing pipe 29 and are flat or elliptic in shape. The cylinders 144 are each circular in shape in cross section perpendicular to the axis, and the cylinders 143 maintaining the air ducts 145 in communication with the cylinders 144 are each in the form of a hollow cone having a circularly surface, as shown in FIG. 20. An end portion **144*a* of each cylinder 144 located radially outwardly thereof is connected to one of air extracting ports 147 formed in a seal member 146. A seal is provided by the aforesaid seal means 128, for example, between the seal member 146 and a flange 148 formed in the hood 32** and extending axially thereof.

In the embodiment shown in FIGS. 16–20, the receiving and distributing pipe 29 has increased strength, and an improved airtight seal can be provided between the seal member 146 and the seal flange with a simplified construction.

Figure 21:
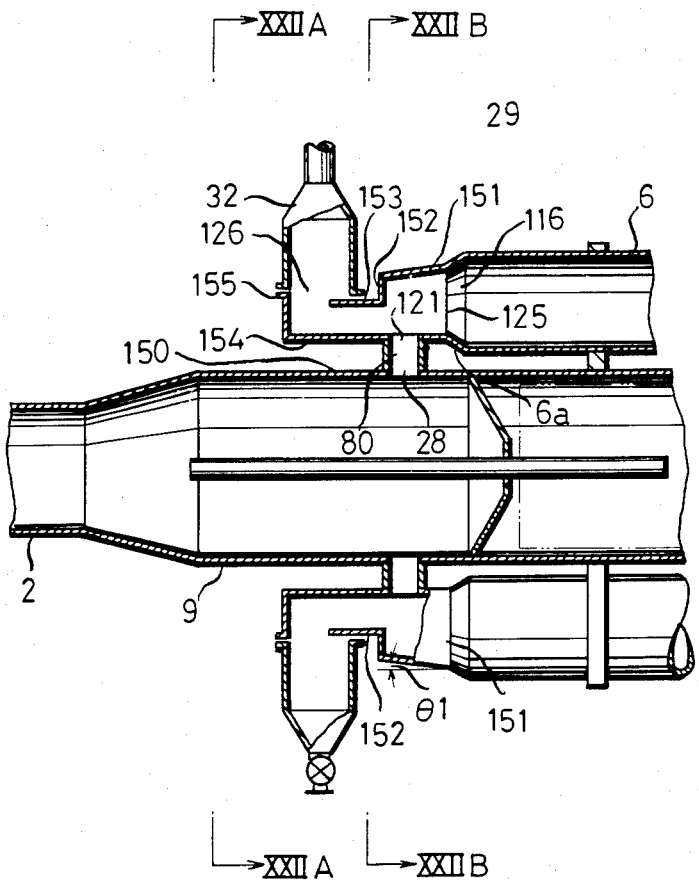
FIG. 21 is a sectional view of a still another example of the air extracting means.
Figure 22:
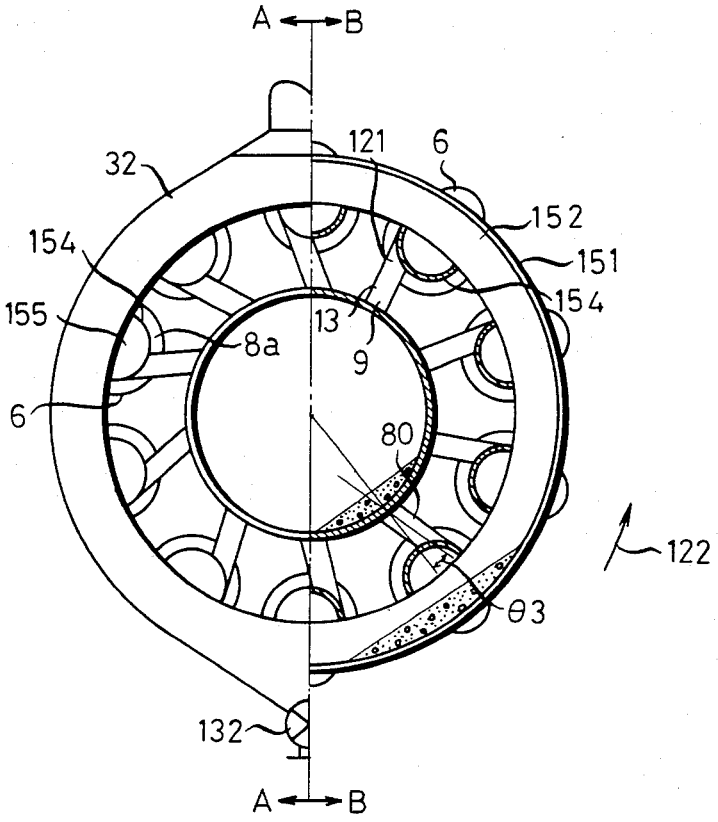
FIG. 22 is a sectional view of the air extracting means shown in FIG. 21.
Figure 23:
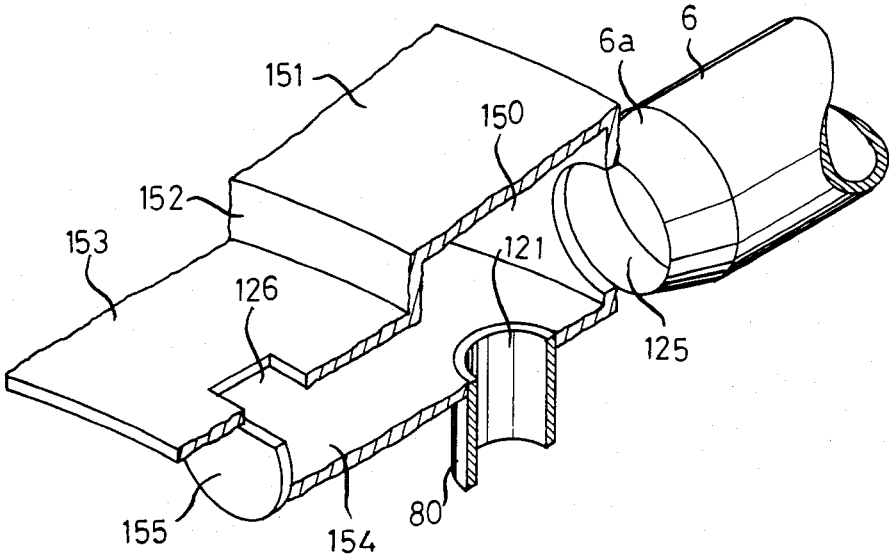
FIG. 23 is a sectional view, with certain parts being cut out, of the air extracting means shown in FIGS. 21 and 22.

FIG. 21 is a vertical sectional view of a further embodiment of the invention. FIG. 22 shows in a left half-portion thereof a sectional view taken along the line XXIIA—XXIIA in FIG. 21 and in a right half-portion thereof a sectional view taken along the line XXIIB—XXIIB in FIG. 21. In FIGS. 21 and 22, parts similar to those shown in FIGS. 1–20 are designated by like reference characters. The receiving and distributing pipe 29 comprises an inner cylindrical member 150, an outer cylindrical member 151, a front end wall 116 formed with material outlet ports 125 each communicating with a material inlet port 6a of each of the cooling cylinders 6, a rear end wall 152, an outer peripheral wall 153 extending from the rear end wall 152 toward the rotary kiln 2 concentrically therewith, semi-arcuate portions 154 protruding radially inwardly of an inner peripheral wall 150, and end walls 155 each closing one of the semi-arcuate portions 154. The semi-arcuate portions 154 are equal in number to the cooling cylinders 6 and associated therewith respectively. The center axis of each of the semi-arcuate portions 154 and the center axis of the associated one of cooling cylinders 6 form a straight line which is parallel to the center axis of the rotary kiln 2. The air extracting apertures 126 are formed at the outer peripheral wall 153 on the side of the rotary kiln 2 which is in communication with the hood 32. The outer cylindrical portion 151 is inclined by $\theta 1$ degrees with respect to the center axis of the rotary kiln 2 in such a manner that the diameter of the outer cylindrical portion 151 is reduced in going toward the kiln 2. The chutes 80 maintaining the outlet end 9 of the kiln 2 in communication with the semi-arcuate portions 154 are each inclined by $\theta 3$ degree in the direction of rotation of the kiln 2 as indicated by an arrow 122 with respect to the radius of the outlet end 9, as clearly shown in FIG. 22. In this embodiment, it is possible to obtain an overall compact size in a receiving and distributing pipe 29, so that support means for the receiving and distributing pipe 29 can be simplified in construction and tires and rollers of the kiln can be reduced in size.

In all the embodiments of the invention shown and described hereinabove, an oxygen concentration has been described as being sensed at the feed side 22 of the rotary kiln 2 and at the outlet of the calciner 8 to effect control of the flow rate of the heated air. The invention is not limited to this arrangement and some other gas component capable of indicating the condition of combustion in the rotary kiln 2 and the calciner 8, such as carbon dioxide or $NO_X$, may have its concentration sensed, in place of oxygen, so as to effect control of the flow rate of the heated air.

From the foregoing description, it will be appreciated that according to the invention control of the flow rate of heated cooling air used for calcining material in the calciner and rotary kiln is effected independently of control of the flow rate of air for combustion, so that the calcined materials discharged through the outlet of the planetary cooler can have their temperature adjusted to a predetermined value. This enables the calcined material discharged through the outlet of the cooler to have an arbitrarily selected temperature regardless of changes in the quantity and particle size of the calcined materials from the kiln and variations in the operating conditions of the kiln. The quantity of air supplied to the kiln and the calciner is enough only for sustaining combustion therein, so that the combustion in the kiln and the calciner can be stabilized and production of oxides of nitrogen in the calcining furnace can be suppressed. Cooling can be effected by using a higher flow rate of cooling air than combustion air, to enable an overall compact size to be obtained in a planetary cooler.

As clearly seen in all the examples shown in the drawings, the air extracting means is constructed such that the receiving and distributing pipe of the planetary cooler is spaced apart from the outlet end of the rotary kiln radially thereof and no parts are exposed to elevated temperatures at opposite sides. This improves the resistance of the firing system to heat and enables stable operation of the calcining system to be performed continuously for a prolonged period of time. The seal means for the hood for the extracting air is mounted outside the rotary kiln, so that an airtight seal can be readily provided and maintenance is facilitated.

What is claimed is:

1. A calcining system wherein raw material is preheated by raw material preheating means for preheating the raw materials by contact with a gas, calcined in a rotary kiln and cooled in a planetary cooler; a portion of cooling gas used for cooling the calcined materials in the planetary cooler and heated thereby is led through an air extracting duct to said raw material preheating means and the rest of the heated cooling gas is introduced into the rotary kiln; and exhaust gases from the rotary kiln is led to the raw material preheating means, wherein the improvement comprises:

a first damper mounted in a duct for exhausing the exhaust gas from said raw material preheating means;

a temperature sensor for sensing the temperature of calcined material discharged through an outlet of said planetary cooler;

a control means operative to increase the degree of opening of said first damper when the temperature sensed by said temperature sensor rises to a high level;

a second damper mounted in said air extracting duct;

a gas sensor for sensing a gas component capable of indicating the condition of combustion in the rotary kiln; and a control means for controlling the degree of opening of the second damper so as to bring the value of the gas component sensed by the gas sensor to a predetermined level.

2. A calcining system as claimed in claim 1 wherein said raw materials preheating means comprises a suspension type heat exchanger including a plurality of cyclones arranged vertically in a plurality of stages and connected together through ducts, and a calciner; the air extracting duct branches into a branch duct connected to the suspension type heat exchanger and a branch duct connected to the calciner; a third damper is mounted in the branch duct connecting the air extracting duct to the suspension type heat exchanger; a gas sensor for sensing a gas component capable of indicating the condition of combustion in the calciner is provided; and control means for controlling the degree of opening of the third damper is provided for bringing the value of the gas component sensed by the gas sensor to a predetermined level.

3. A calcining system as claimed in claim 1 wherein said planetary cooler comprises:

a plurality of cooling cylinders connected to an outlet end of the rotary kiln for rotation as a unit therewith and extending parallel to the rotary kiln lengthwise thereof, said plurality of cooling cylinders being arranged around said outlet end for rotation in an orbit like the planets;

a plurality of material outlet apertures formed at a peripheral wall of the outlet end and equidistantly spaced apart from one another peripherally thereof;

an annular receiving and distributing pipe mounted on the outlet end to enclose the material outlet apertures concentrically therewith in radially outwardly spaced-apart relation;

a plurality of chutes each connecting one of said materials outlet apertures to said receiving and distributing pipe;

material inlets each associated with one of said cooling cylinders, said material inlets connecting the cooling cylinders to said receiving and distributing pipe at one end wall thereof;

air extracting opening means facing radially outwardly formed in said receiving and distributing pipe; and a hood mounted radially outwardly of said receiving and distributing pipe and supported in a fixed position, said hood airtightly enclosing said air extracting opening means and maintained in communication therewith.

* * * * *